US005251774A

United States Patent [19]

Engle

[11] Patent Number: 5,251,774

[45] Date of Patent: Oct. 12, 1993

[54] LID WITH UTENSIL AND HANDLE

[76] Inventor: Willis S. Engle, 18367 Manorwood West, Mt. Clemens, Mich. 48044

[21] Appl. No.: 926,753

[22] Filed: Aug. 7, 1992

[51] Int. Cl.[5] ..... B65D 51/24

[52] U.S. Cl. ..... 220/212; 220/212.5; 215/228; 215/100 A; 215/DIG. 5

[58] Field of Search ..... 220/212, 212.5, 757, 220/762, 768; 215/100 A, DIG. 5, 228; 206/541; 229/1.5 C

[56] References Cited

U.S. PATENT DOCUMENTS

| | | | |
|---|---|---|---|
| 1,834,085 | 12/1931 | Bloom . | |
| 1,840,662 | 1/1932 | Fischer | 220/212 X |
| 1,990,705 | 2/1935 | McMillan | 220/757 X |
| 2,134,090 | 10/1938 | Scheemaeker | 215/DIG. 5 X |
| 2,738,900 | 3/1956 | Wenger | 215/DIG. 5 X |
| 3,955,742 | 5/1976 | Marshall et al. | 229/1.5 C |
| 4,216,875 | 8/1980 | Stanish . | |
| 4,298,135 | 11/1981 | Vossen | 220/371 |
| 4,393,988 | 7/1983 | Burke . | |
| 4,717,032 | 1/1988 | Wu | 215/228 |

*Primary Examiner*—Allan N. Shoap
*Assistant Examiner*—Nova Stucker
*Attorney, Agent, or Firm*—Phelps Dunbar

[57] ABSTRACT

A lid for closing the opening of a container, which incorporates a utensil for use in removing, using or consuming the contents of the container, and which further incorporates a handle to facilitate use of the utensil. When not in use the handle components lie flat on the top of the container to allow for stacking of the containers. The handle is formed by rotating the handle halves about a flexible joint and connecting them together such that the handle extends outwardly from the upper surface of the lid.

7 Claims, 2 Drawing Sheets

LID WITH UTENSIL AND HANDLE

This invention relates to a lid for various types of containers, which incorporates a utensil for use in removing, using, or consuming the contents of the container and which further incorporates a handle to facilitate use of the utensil.

BACKGROUND OF THE INVENTION

Many containers, holding a variety of materials, are often used under circumstances where access to a utensil for removing, using or consuming the contained material is limited. Accordingly, a number of containers are available which are in some manner attached to or packaged with a utensil for use by the consumer. Additionally, certain contained materials may be harmful to utensils owned by or available to the consumer. Under such circumstances it is advantageous for a utensil compatible with the contained material to be supplied with the container. Finally, products that include a utensil that may be disposed of with the container after use of the contained material may be more attractive to the consumer, since no clean up or maintenance of the utensil is required.

The prior art discloses a number of containers with lids that in some fashion incorporate a utensil. U.S. Pat. No. 4,216,875 to Stanish discloses a utensil frictionally held to the inside of a container lid. However, the Stanish utensil can only be as long as the container lid is wide, and has no distinct handle area. The contained material would likely come into contact with the consumer during use of such a utensil. U.S. Pat. No. 4,393,988 to Burke discloses a utensil which forms an integral part of a lid, with the lid itself serving as a handle for the utensil. Burke also suffers from limitations on the length and function of the utensil. Additionally, the lid/handle would likely come into contact with the contained material during use, necessitating cleanup or premature disposal of the container and lid.

It is the principal object of this invention to provide a lid for a container, incorporating both a utensil and handle, which allows for convenient removal, use, or consumption of the contained material. Another object of this invention is the provision of a lid with utensil and handle which has a flat upper surface such that container may be easily stacked. Other objects of this invention include the provision of a lid with utensil and handle which may be used without risk of the user unintentionally coming into contact with the contained material, which may be reused numerous times without the need for cleanup or maintenance of the lid, utensil or handle, and which is durable, easy to manufacture and inexpensive.

SUMMARY OF THE INVENTION

The invention comprises a lid, adapted to securely attach to a container opening in a removable and reusable fashion, which incorporates a utensil extending from the underside of the lid into the container, and which further incorporates a handle on the top of the lid. The handle is comprised of two portions which lie flat when not in use, such that the surface of the lid may be generally flat. When in use the two portions of the handle are moved together and removably affixed to each other such that a functional handle is formed.

DESCRIPTION OF THE PREFERRED EMBODIMENT

Figure 1:
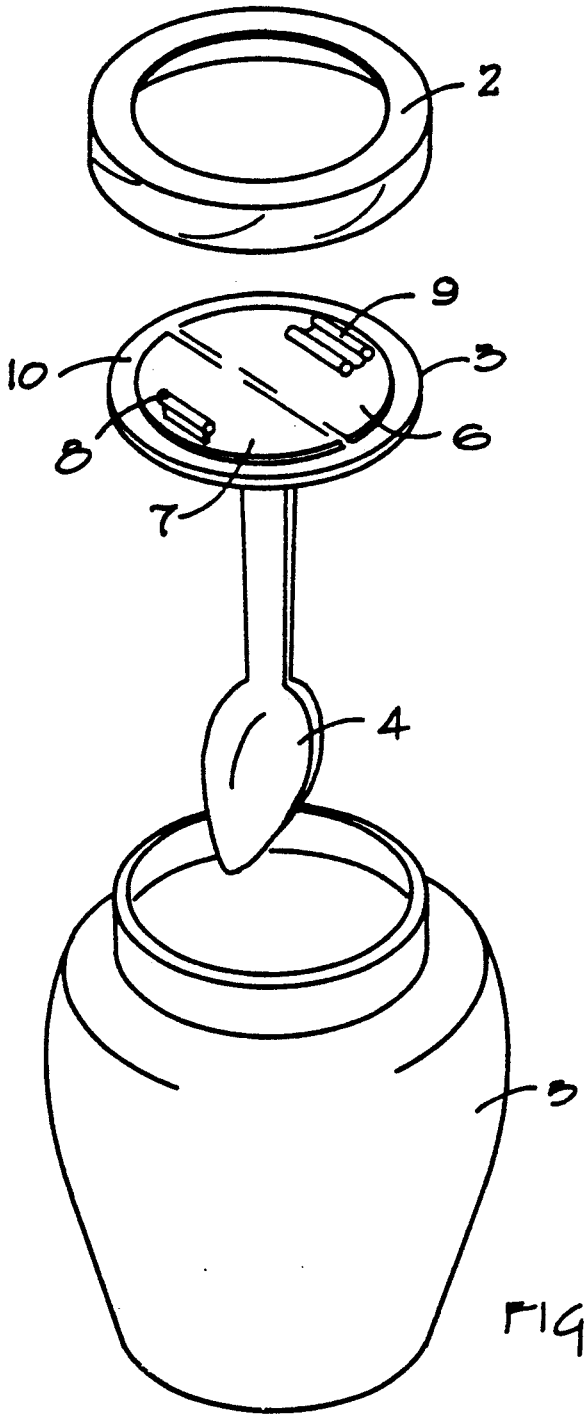
FIG. 1 is a perspective view of a lid with utensil and handle embodying the invention.
Figure 3:
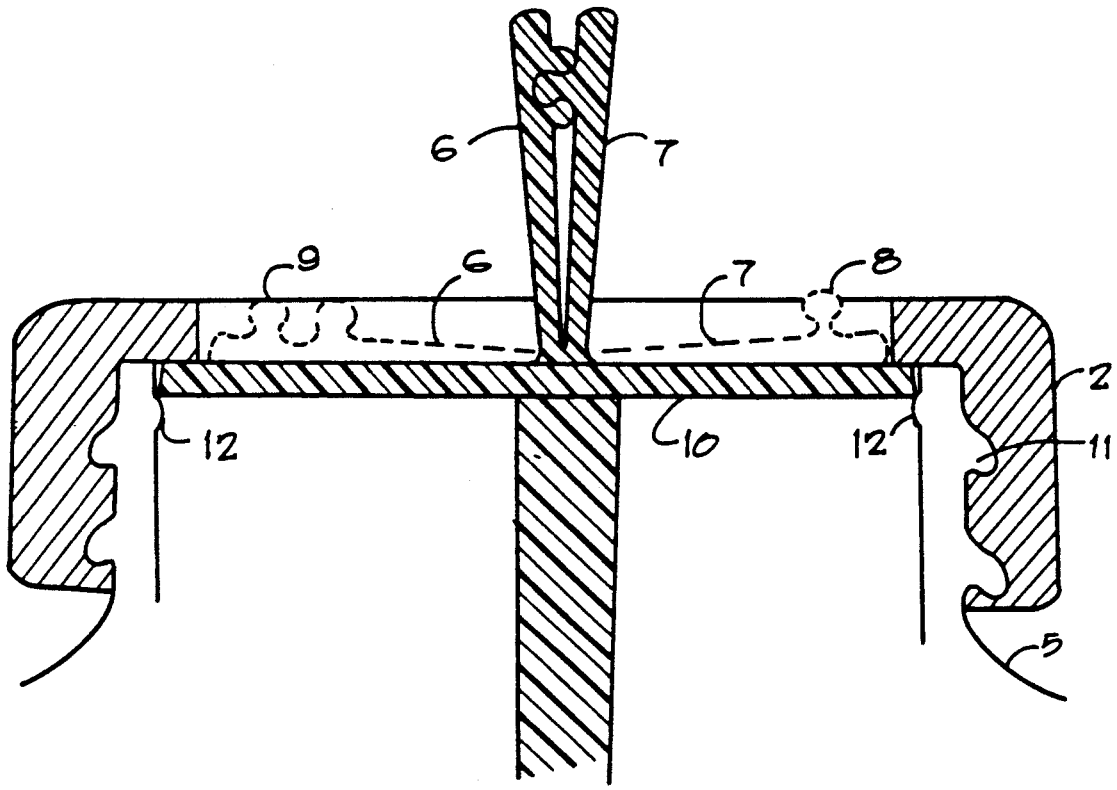
FIG. 3 is a cross sectional view of a lid and handle embodying the invention.

As best seen in FIG. 1, the preferred embodiment of the invention involves a two piece lid system. The utensil/handle portion 3 includes a utensil 4 which extends from the underside of the closure plate 10 into the container 5. The utensil 4 may have any of several forms, including a spoon (as shown), fork, knife, or spear. Attached to the upper surface of the closure plate 10 is the handle mechanism, which is comprised of two halves 6 and 7. The two handle halves 6 and 7 are flexibly attached to the closure plate 10 along a line passing through the center of the closure plate 10. Fastening means are supplied on the two handle halves 6 and 7 such that they may be removably connected. In this embodiment this is accomplished through the use of connecting members 8 and 9. When the two handle halves 6 and 7 are moved together, connecting member 8 snaps into the space between the two protrusions of connecting member 9. This connection, while sufficient to keep handle halves 6 and 7 together, can be easily broken by pulling the handle halves 6 and 7 apart. In this manner the handle can be used and then returned to its nonfunctional condition such that the top of the utensil/handle portion 3 is generally flat. The relative positions of the handle halves 6 and 7 and the connection between connecting members 8 and 9 is best seen in FIG. 3.

Figure 2:
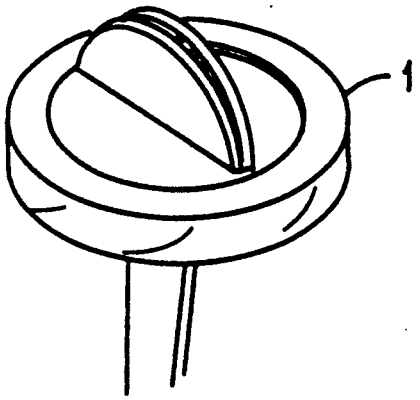
FIG. 2 is a perspective view of a lid and handle embodying the invention, showing the handle in the functional position.

The utensil/handle cover 2 is designed to securely but removably connect the utensil/handle portion 3 to the container 5. In this embodiment the cover 2 is threaded to match threads 11 on container 5, as best seen in FIG. 3. However, the cover 2 may take any form required to accommodate the opening of container 5. Cover 2 overlaps and holds closure plate 10 securely in place against lip 12 of container 5. Alternatively, closure plate 10 may be dimensioned to rest on the top of the opening of container 5. Cover 2 would then urge closure plate 10 tightly onto the opening of container 5 rather than against lip 12. Handle halves 6 and 7 are dimensioned such that they may be connected together without interference from cover 2, as best shown in FIG. 2.

The utensil 4 should be dimensioned such that it is long enough to fully remove the contents of container 5. Utensil 4 may be made from a flexible plastic and actually dimensioned to be slightly longer than the distance from the opening of container 5 to the bottom of container 5. In this manner, the utensil 4 will be forced to bend slightly, or move toward the outer portion of container 5, upon tightening of the cover 2 on the opening of container 5. This will insure that utensil 4 is of sufficient length to be of use in extracting all of the contents of container 5.

Various materials of construction may be used. Flexible plastics are preferred for most applications, although certain contained materials may be incompatible with certain plastics, necessitating use of other more compatible materials. Having thus described the invention, it should be apparent that numerous modifications are contemplated as being part of this invention as set forth above, and as defined below by the claims.

What is claimed is:

1. A lid with utensil and handle for use with a container comprising:

a closure plate dimensioned to close the opening of the container;

a utensil attached to the underside of said closure plate adapted to extend into the container;

handle means attached to the upperside of said closure plate to facilitate use of said utensil, said handle means comprised of a plurality of handle sections flexibly attached to said closure plate in a manner which allows said flexibly attached handle sections to lie flat against said closure plate when not in use, and which further allows said flexibly attached handle sections to be rotated together whereby said flexibly attached handle sections together form said handle means;

securing means to removably secure said closure plate to the container; said handle sections comprising connecting means for removably connecting said flexibly attached handle sections to each other when said flexibly attached handle sections are rotated together to form said handle means.

2. The device described in claim 1 wherein said connecting means comprises an elongated protrusion on one of said flexibly attached handle sections which removably snaps into a space between two parallel elongated protrusions on another of said flexibly attached handle sections when said flexibly attached handle sections are rotated together to form said handle means.

3. The device described in claim 1 wherein said utensil is a spoon.

4. The device described in claim 1 wherein said utensil is a fork.

5. The device described in claim 1 wherein said utensil is a knife.

6. The device described in claim 1 wherein said utensil is a spear.

7. The device described in claim 1 wherein said securing means comprises a cover dimensioned to slightly overlap said closure plate, said cover having a central opening accommodating said handle means, and said cover having a flat upper surface to facilitate stacking of the containers.

* * * * *